US005848482A

United States Patent [19]

Bathum

[11] Patent Number: 5,848,482

[45] Date of Patent: Dec. 15, 1998

[54] CLEAT ASSEMBLY FOR SHOES

[76] Inventor: Dale Bathum, 4610 E. Mercer Way, Mercer Island, Wash. 98040

[21] Appl. No.: 768,846

[22] Filed: Dec. 18, 1996

[51] Int. Cl.[6] ..... A43B 5/00

[52] U.S. Cl. ..... 36/127; 36/134

[58] Field of Search ..... 36/134, 67 D, 36/59 A, 127

[56] References Cited

U.S. PATENT DOCUMENTS

| | | |
|---|---|---|
| 1,344,972 | 6/1920 | Armour . |
| 1,797,668 | 3/1931 | Morisse . |
| 4,492,047 | 1/1985 | Arff . |
| 5,367,793 | 11/1994 | Deacon et al. . |
| 5,475,937 | 12/1995 | Korsen . |
| 5,617,653 | 4/1997 | Walker et al. . |
| 5,638,615 | 6/1997 | Korsen . |

FOREIGN PATENT DOCUMENTS

| | | |
|---|---|---|
| 2644989 | 10/1990 | France . |
| 2154951 | 5/1973 | Germany . |
| 18544 | 9/1891 | United Kingdom . |
| 320029 | 10/1929 | United Kingdom . |

*Primary Examiner*—Ted Kavanaugh
*Attorney, Agent, or Firm*—Marvin E. Jacobs

[57] ABSTRACT

The invention is a shoe cleat assembly which when incorporated into the outsole of a shoe will provide a shoe cleat that may be conveniently and easily changed by lifting out the installed cleat and pressing in the replacement. In the preferred embodiment the cleat assembly comprises a cleat body and a cooperating receptacle. The cleat body has a cleat surface and an attachment stud having an axial longitudinal bore. The receptacle is incorporated into a shoe outsole and has an elongated cavity with a central post. In operation, the cleat body is pressed into the receptacle wherein the attachment stud enters the cavity and the axial longitudinal bore of the attachment stud receives the post within the cavity. In this manner the cleat body is removably and resiliently received and frictionally engaged by the receptacle. The cleat assembly may be fabricated from a broad variety of materials that provide the required strength, durability, friction and resiliency properties.

12 Claims, 5 Drawing Sheets

CLEAT ASSEMBLY FOR SHOES

TECHNICAL FIELD

The present invention relates to a shoe cleat assembly including a cleat that is removably pressed into a cooperating receptacle in the outsole of a shoe.

BACKGROUND OF THE INVENTION

A plethora of shoe cleats and spikes exist to improve the traction of athletic shoes. Most of these devices comprise some form of a cleat or group of cleats which are attached to the ground engaging portion of the shoe outsole or other apparatus where improved traction is being sought. Commercially available cleats or studs are either an integral part of the outsole or have threaded bases which are screwed into female threads within a receptacle include in the shoe's outsole. Cleats and studs are now available which are designed for different applications or traction conditions. These cleats are fabricated from metal alloys and durable synthetic plastic resins and elastomers. Their configurations vary from the aggressive metal cleat of a conventional golf shoe to a soft rubber protuberance or nub on the shoe outsole that provides moderate traction increases but will not damage golf putting greens, golf fairways, hardwood flooring, carpets and other vulnerable materials. Such a cleat is described in my copending application Ser. No. 08/633,835 filed on Apr. 2, 1996 still pending, the disclosure of which is expressly incorporated herein by reference.

To increase the general utility of such specialized cleats, the spike must be readily removable allowing the wearer of the shoe to meet his/her changing needs for spikes without having to change shoes. Rather, he/she merely changes the spikes. Although the current commercially available threaded spike allows spike replacement, the process of threading and unthreading these spikes is slow and cumbersome. Threads on the spike base and in the receptacles are easily galled, cross threaded or otherwise damaged.

Alternatives to the threaded attachment of spikes and studs have been previously described. However, their commercial availability is limited due to the complexity of their designs, difficulty and expense of fabrication, excessive weight and an inability to produce reliable and effective products.

There remains a strong need for a removable/replaceable shoe spike or cleat that is easy to install and remove, is reliable and robust, is not susceptible to breakage or damage of its attachment mechanism, and is readily manufactured and inexpensive.

STATEMENT OF THE PRIOR ART

Hollister and Kavanagh (U.S. Pat. No. 3,331,148) describe a "cleat means" for athletic shoes consisting of two preferred configurations. The first is a ground contacting spike or cleat having an internal socket for receiving an attaching post previously secured to and protruding downwardly from a shoe sole. The critical geometric relationship between the socket and the post is that certain dimensions transverse to the longitudinal axis of the post are larger than the socket. Thus, as the cleat is forced over the post, the socket material (a plastic) is compressed. The compressed state produced in the socket material causes it to expand against the more rigid post material and thereby secures the socket to the post and thus to the athletic shoe. This configuration permits the spike to be axially inserted into the socket without rotary motion.

The second preferred configuration is essentially the complement of the first configuration wherein the post is integral with the cleat and is received by a socket secured to the sole of the athletic shoe. The same critical geometric relationship between the socket and the post applies to this configuration.

In U.S. Pat. No. 2,607,134 Langer describes a "calk" (spike) assembly having a longitudinal hollow holder set in the sole of a shoe. This holder comprises a collar having a transverse groove surrounding its external periphery which produces a circumferential ridge on the inside of the collar. The collar is also adapted for radial expansion and contraction. The spike has a shank end with a circumferential groove which, when inserted into the holder, cooperates with the internal ridge of the collar to firmly retain the spike in the holder. This configuration also permits the spike to be axially inserted into the holder without rotary motion.

A second invention by Langer (U.S. Pat. No. 2,607,135) incorporates a similar holder and spike arrangement. In this second invention the shank of the spike is modified to incorporate a snap ring which, upon insertion into the holder, is retained by a cooperating shoulder within the holder. Again, insertion of the spike into the holder is by direct axial nonrotary movement.

White et. al. (U.S. Pat. No. 3,715,818) describe a "stud assembly" that is secured into the threaded bore of a conventional golf stud socket. The assembly comprises a flange member and a stud member. The flange member has a boss projecting from the upper surface of the flange and is adapted to fit in the conventional socket in the shoe sole. There is an axial tapered bore passing through the boss and a slot extends across a diameter of the boss forming two halves. The stud member comprises the stud at one end which interacts with the ground surface and a tapered pin at the other end which is linearly inserted into the bore of the boss. The dimensions of the pin are such that the two halves of the boss are forced outwardly and the resulting return forces act on the pin thus retaining it in the boss. The flange member of this invention is typically made from a plastic material, the stud is made from steel or another metal.

Morley (U.S. Pat. No. 3,556,489) describes a replaceable spike comprising two cooperating components. The first is either a one or two piece anchor set in the sole of the shoe and having a receiving chamber. The second component is a replaceable spike member comprising an exterior spike portion at one end and a locking portion at the other end terminating in split fingers having protuberances at their ends. In operation the locking portion of the spike member is pressed into the receiving chamber of the anchor. The protuberances at the ends of the split fingers are retained by a shoulder within the receiving chamber. In this approach the spike is also linearly inserted into its cooperating anchor without rotary motion.

An approach that calls for only partial rotary motion is described by Arff (U.S. Pat. No. 4,492,047). In Arff's design, the cleat or spike is secured to the shoe sole by a bayonet type attachment mechanism. A portion of the cleat having projections engages a socket in the shoe sole. The socket has slots which are aligned for rotatable cooperation with the projections on the cleat.

As can be seen, prior art has attempted to solve the problems and limitations of rotary/threaded cleat/spike attachment methods, but with limited success. The prior nonrotary, press in/press out removable cleats and spikes suffers from complexity, difficulty of fabrication, contamination and damage in use, and generally expensive fabrication methods. The critical need for a cleat or spike that can be quickly and easily replaced to allow ready use of spikes appropriate to meet the wearer's needs remains. Such needs range from a broad variety of sports activities, industrial applications and leisure use at many venues. In a representative scenario, today's golfer wears a pair of street casual shoes while traveling to the golf course, he/she then changes into conventional golf shoes such as previously described, plays a round of golf, changes back to the street casual shoes and then participates in club house activities prior to driving home. Using conventional spiked shoes outside of the sports venue, is uncomfortable to the wearer, subjects the wearer to tripping hazards, and the spikes will damage floors and carpets.

STATEMENT OF THE INVENTION

This invention provides a novel and rugged and easily removable and replaceable cleat and cooperating receptacle. When incorporated into suitable footwear this invention will meet the needs for the rapid change of cleats to meet the varying shoe traction demands of athletic, industrial and leisure activities. The press in and lift out (pop-in/pop-out) feature of this invention, combined with the broad variety of cleat configurations and materials available, provide a quick and convenient means to adapt one pair of shoes to a variety of needs. Cleats are available formed of aluminum and steel alloys and synthetic organic resins, either elastomeric or rigid. The designs of the portion of the cleat that interacts with the terrain or flooring are available to meet the needs for aggressive athletic competition on a variety of playing fields or merely for non-slip applications for walking on pavement in wet or icy conditions.

Thus the same cleated footwear is appropriate and practical for use in many applications, venues and weather conditions. In just one of its many applications, from utility, practicality and aesthetic perspectives, this invention provides a contemporary multi-purpose shoe that is light weight, attractively designed, may be formed from recyclable materials, and is utilitarian in that it can be effectively worn for normal, non-athletic use as well as for sporting activities.

With a golf shoe using the cleats and cooperating receptacles taught by this invention, a golfer can wear the same shoes to and from the golf course, during golf play and in the club house. With these shoes, there is no need to change shoes because the cleats can be changed to meet the specific needs for each venue. A further advantage of the athletic shoe incorporating this invention, is that the sports participant does not need to invest in extra pairs of shoes. A single pair of shoes, using the cleats and receptacle of this invention, meets the many previously stated need that require more than one pair of shoes.

Briefly, a presently preferred embodiment of this invention is an all purpose cleat assembly comprised of a cleat body, having a top surface, a cleat surface and an attachment stud upwardly projecting from the top surface of the cleat body. The attachment stud has a distal end, an external surface and an axial longitudinal bore extending proximate to the top surface of the cleat body to the distal end. Additionally the presently preferred embodiment of this invention has a receptacle for inclusion in a shoe outsole having a base plate, an elongated cavity and a post within the cavity attached to the base plate. The cavity is longer than the stud forming a chamber between the distal end of the post and the bottom of the cavity. In this manner the receptacle is adapted for removably and resiliently receiving and frictionally engaging the attachment stud thus firmly securing the cleat body, with its cleat surface to the shoe.

The receptacle of this invention is integrated into the outsole of the shoe by any of a variety of conventional methods including molding, adhesively bonding or via a multiplicity of mechanical fasteners. The receptacle may be integrated simultaneously with the forming of the shoe outsole or as a later step after the formation of the outsole. Of course the cleats may be inserted and removed at any time by the wearer.

A large variety of cleat configurations are available that are formed from a large range of materials. Typical materials include aluminum and steel alloys and synthetic organic resins, either elastomeric or thermoplastic. A large variety of designs for the portion of the cleat body that interacts with the terrain or flooring are available to meet the needs for aggressive athletic competition on a variety of playing fields or merely for non-slip applications for walking on pavement in wet or icy conditions. The configurations range from sharp, pointed conical metal shapes to mere rounded elastomeric protrusions and nubs.

This invention provides for the replacement of worn cleats thus extending the longevity of the shoe, or cleats of a different configuration or material may be popped-in/popped out to optimize shoe performance for various sporting activities, for specific terrain, for varying weather conditions or for normal wear when walking on streets or at home.

These and many other features and attendant advantages of the invention will become apparent as the invention becomes better understood by reference to the following detailed description when considered in conjunction with the accompanying drawings.

DETAILED DESCRIPTION OF THE INVENTION

Figure 1:
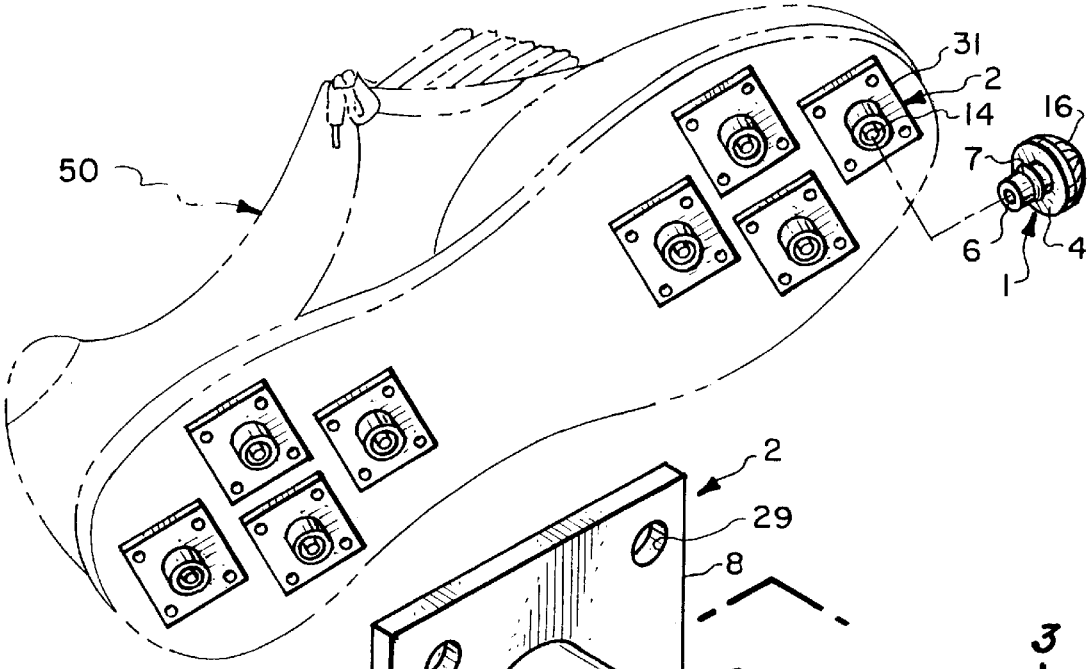
FIG. 1 shows the construction of a shoe sole depicting the bottom of the outsole including a first embodiment of the cleat assembly of this invention.
Figure 2:
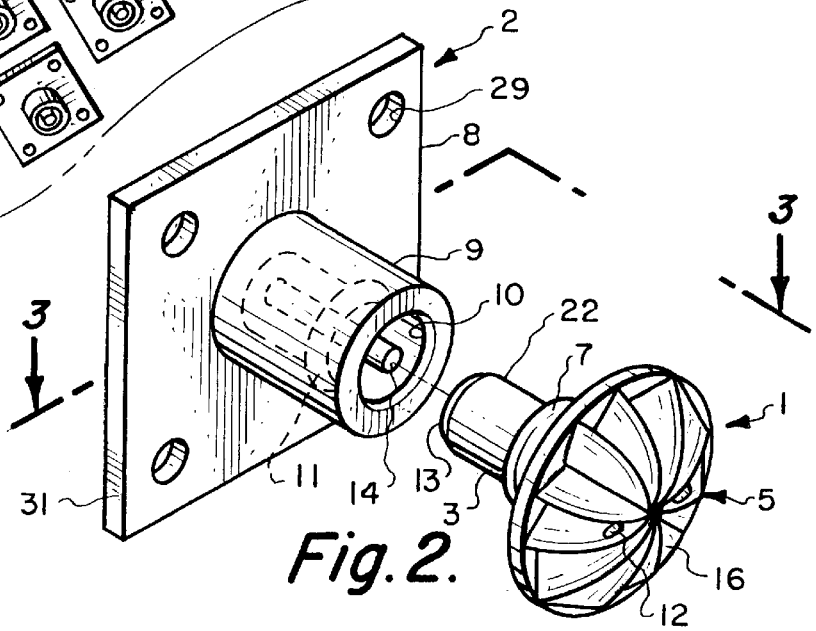
FIG. 2 is an isometric view of the cleat assembly of the invention.
Figure 3:
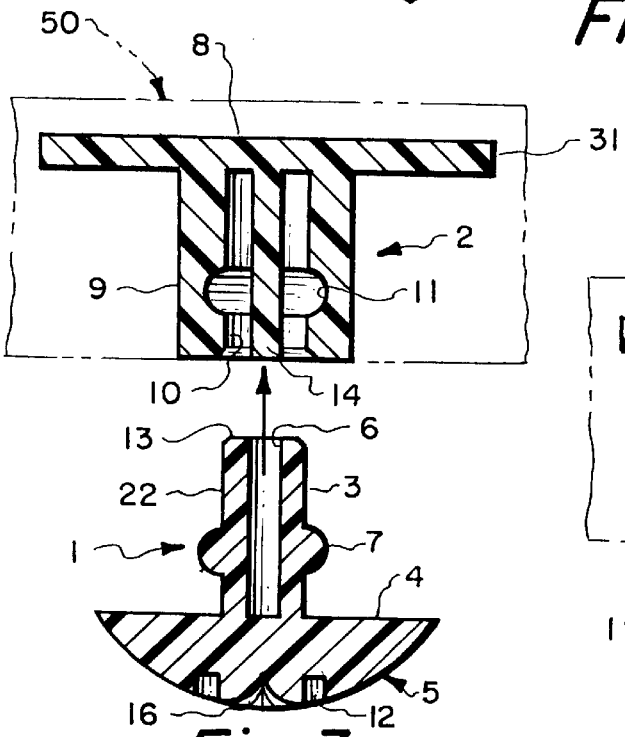
FIG. 3 is a view in section taken along line 3—3 of FIG. 2.
Figure 4:
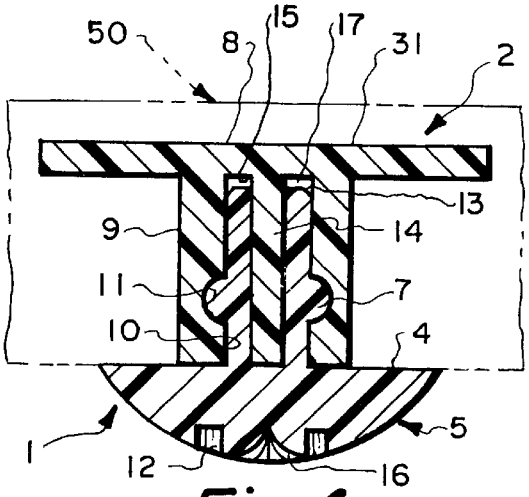
FIG. 4 is a view in section of an assembled cleat assembly in a preferred embodiment.
Figure 5:
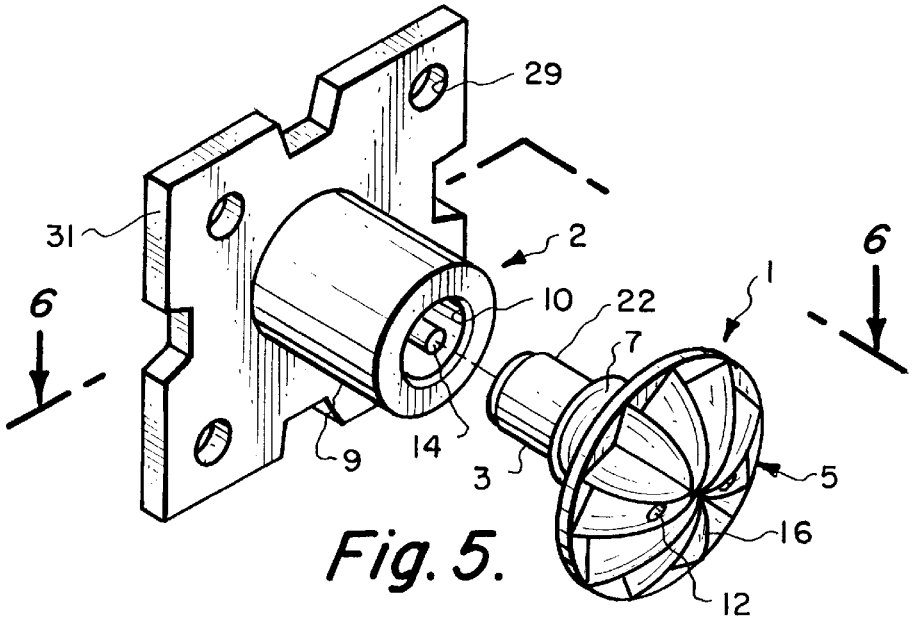
FIG. 5 is an isometric view of another embodiment of the cleat assembly.

Referring now to FIGS. 1–4, a first embodiment of this invention is shown depicting a cleat body 1 being received in the receptacle 2. The cleat assembly is shown included in a shoe 50. The receptacle 2 shown in FIGS. 2–3 has a post 14 disposed within a hollow cylindrical wall 9, defining an elongated annular cavity 10. Both the wall 9 and post 14 are attached to the base plate 8. The wall 9 includes a circumferential groove 11. An attachment stud 3 is secured to the top surface 4 of the cleat body 1 and extends to its distal end 13. A retaining ridge 7 disposed on the external surface 22 of the attachment stud 3 is aligned to receive and cooperate with the circumferential groove 11 in the receptacle 2. The attachment stud 3 also has an axial longitudinal bore 6 which receives the post 14 of receptacle 2. FIG. 4 also shows the cleat surface 5. The cleat surface 5 may be optimized in many ways for developing the desired traction with the ground surface, turf, golf greens, hardwood floors, carpets, etc. Traction ribs 16 are shown in FIG. 4. The removal channels 12 provide for the insertion of a tool to allow convenient removal of the cleat body 1 by a "pop-out" action where no rotation is required. FIGS. 2 and 5 illustrates representative locations for bonding apertures 29 in the base plate 31 of the receptacle 2.

Referring again to FIGS. 3 and 4, in operation, as the cleat body 1 is pressed into the receptacle 2, post 14 is received by the axial longitudinal bore 6, and attachment stud 3 is frictionally and resiliently received within elongated cavity 10. The annular cavity 10 in the receptacle 2 is longer than the attachment stud 3. In the final "home" position of the attachment stud 3, the retaining ridges 7 are aligned with, and are frictionally and resiliently received by the circumferential groove 11 in receptacle 2. The cleat body 1 is securely retained by the receptacle 2 by virtue of the geometric relationships of the attachment stud 3, the elongated cavity 10, post 14, the retaining ridge 7 and the circumferential groove 11. The distal end 13 of the attachment stud 3 is seated above the bottom surface 15 of the cavity 3 forming an annular chamber 17.

An important aspect of this invention is the suitability of a very broad variety of materials from which this invention may be fabricated. In the preferred embodiment the receptacle is formed from a metal, either a steel or high strength aluminum alloy. Alternatively, the receptacle can be formed from a high strength thermoplastic resin. In the preferred embodiment the cleat body is formed from a durable elastomer that provides optimum strength and a cleat surface that enhances traction but does not damage sensitive golf greens, clubhouse floors or carpets, etc. The cleat body 1 can also be formed as a composite construction where, for example the attachment stud 3 is fabricated from a thermoplastic resin and the cleat surface is fabricated from an elastomer. Other material combinations will be readily identified by those skilled in the art.

A critical benefit and feature of this invention is the enhanced stability and security of the cleat body 1 in the receptacle 2 that is provided by post 14 in cooperation with the axial longitudinal bore of the attachment stud 3. When fabricating the cleat body 1 and receptacle 2 the dimensions of the attachment stud 3, the elongated cavity 10 and the post 14 are carefully selected and controlled to provide for the optimum balance of frictional cooperation between the mating parts yet retain easy of insertion and removal of the cleat body 1 into receptacle 2.

Figure 6:
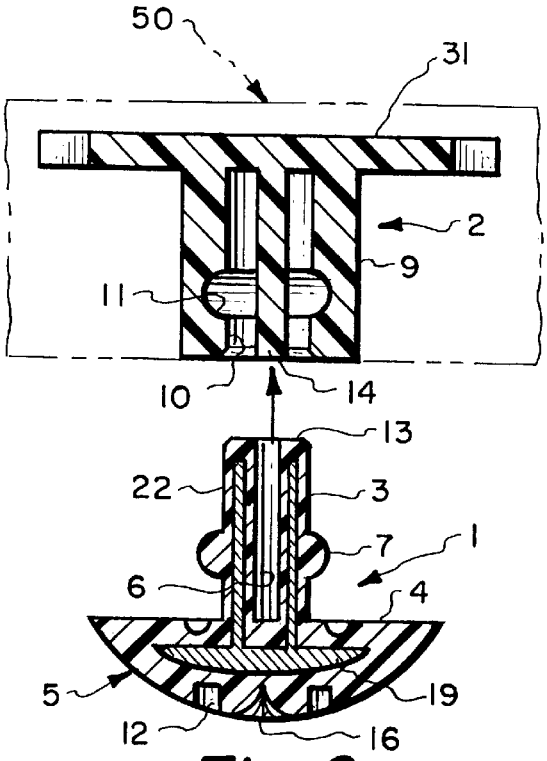
FIG. 6 is a view in section taken along line 6—6 of FIG. 5.
Figure 7:
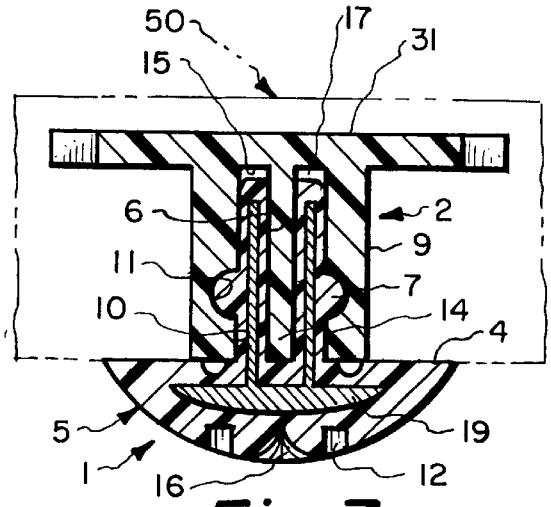
FIG. 7 is a view in section of the assembled cleat assembly shown in FIG. 6.

Another method of providing optimum strength and performance of the cleat assembly is to incorporate a reinforcement member 19 in the attachment stud 3 as shown in FIGS. 5, 6 and 7. Reinforcement member 19 may have the "mushroom" configuration shown in FIG. 6 or myriad other configurations for the reinforcement member 19 will be obvious to the designer. The reinforcement member 19 may be formed of any material including metals, high modulus elastomers, and synthetic plastic resins.

Figure 8:
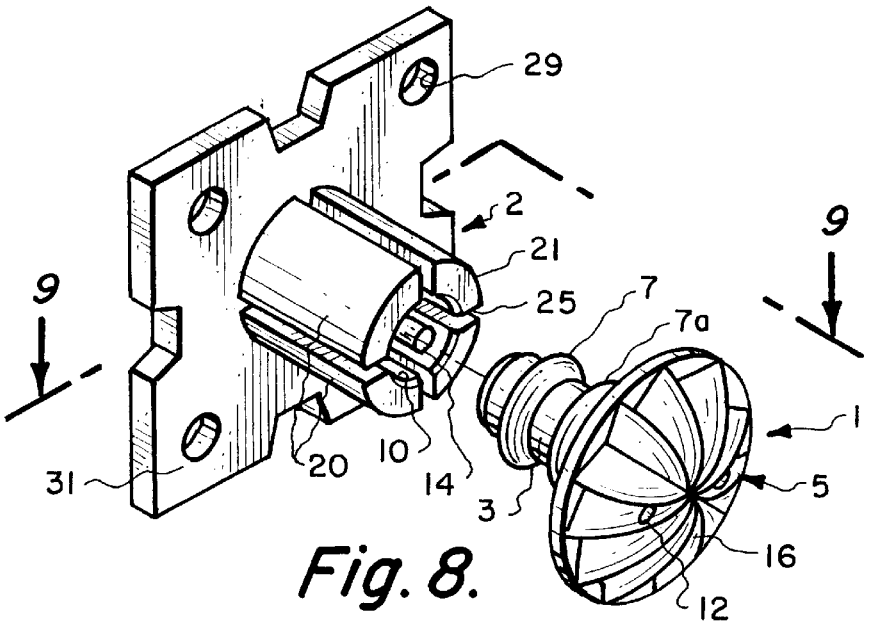
FIG. 8 is an isometric view of a further embodiment of the cleat assembly in which the receptacle has a plurality of wall sections.
Figure 9:
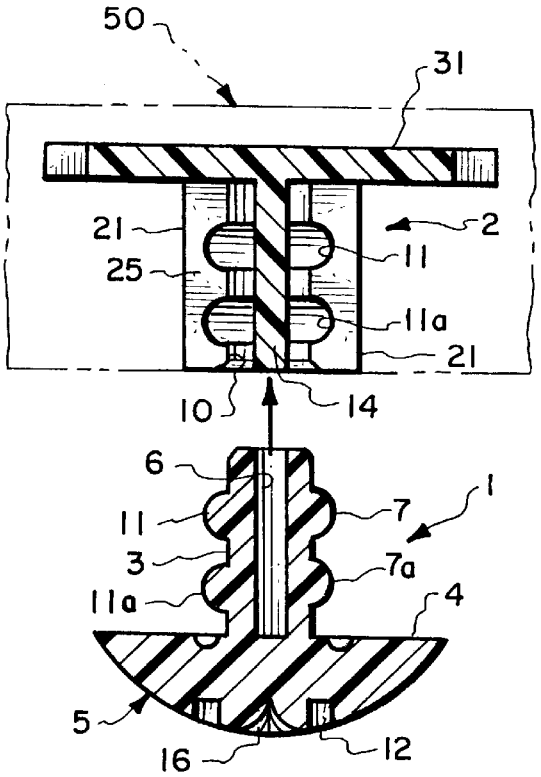
FIG. 9 is a view in section taken along line 9—9 of FIG. 8.

FIG. 8 shows an alternative configuration of the receptacle 2 wherein the wall 21 defining the elongated cavity 10 has a plurality of longitudinal slots 25 that separate the wall 21 into wall sections 20. FIG. 9 depicts the plurality of wall sections in relation to the elongated cavity 10 and the post 14. Because of the strength and resiliency of the materials selected for the wall 21, the receipt of the attachment stud 3 into the receptacle 2 is facilitated and the security of the resulting cleat assembly is enhanced. Careful selection of the materials and the dimensions of the attachment stud 3 and the wall 21 will cause the wall sections 20 to press inwardly against the attachment stud 3 thus enhancing its retention in the receptacle 2.

Figure 10:
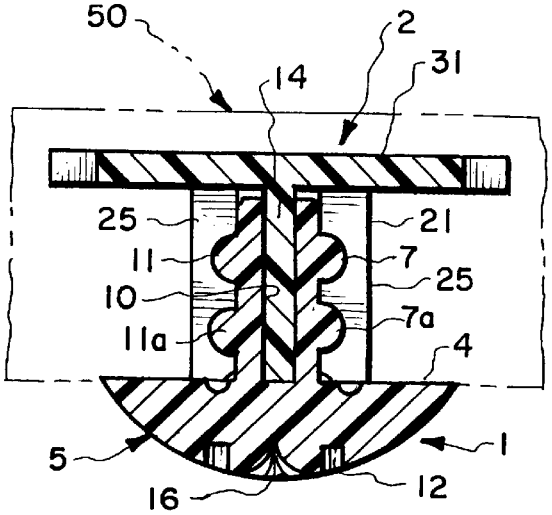
FIG. 10 is a view in section of a receptacle having a plurality of circumferential grooves assembled to a cleat having a plurality of circumferential ridges.
Figure 11:
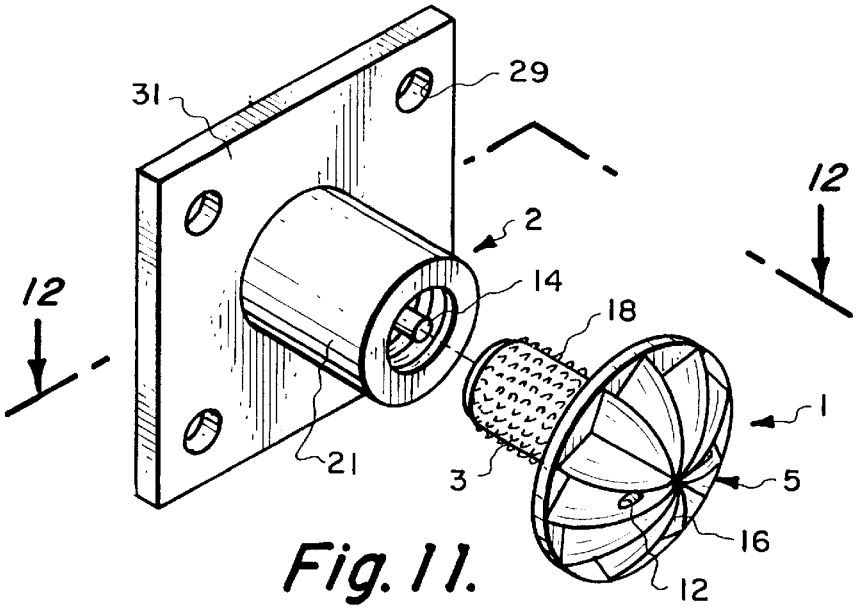
FIG. 11 is an isometric view of a still further embodiment of a cleat assembly in which the cleat body has a roughened external surface on the attachment stud.
Figure 12:
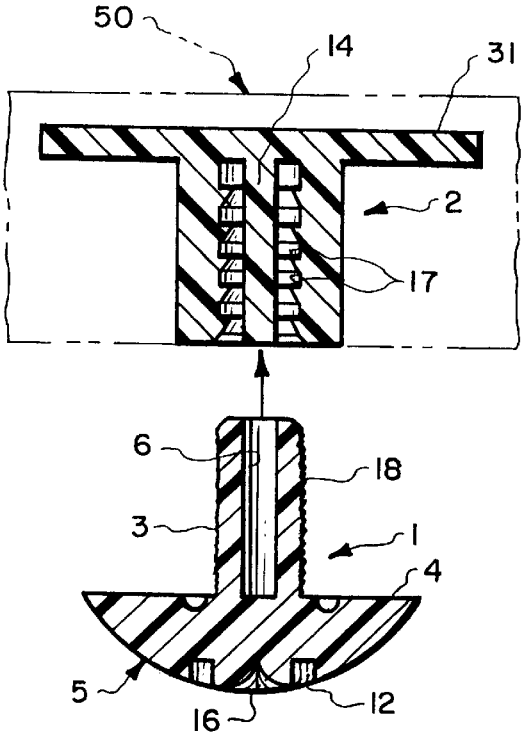
FIG. 12 is a view in section taken along line 12—12 of FIG. 11.
Figure 13:
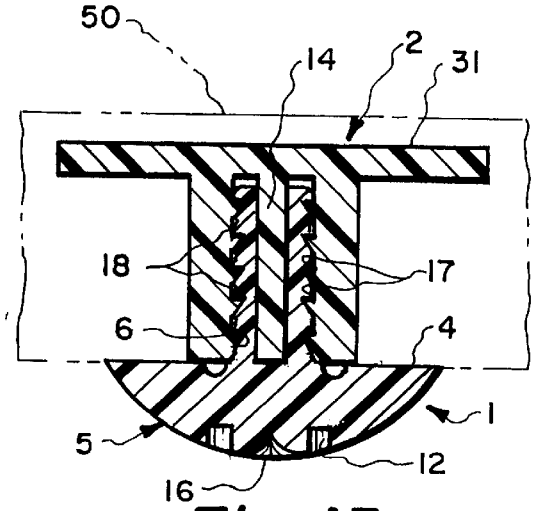
FIG. 13 is a view in section of the assembled cleat and receptacle shown in FIG. 12.

Another feature of the invention is an attachment stud 3 having a plurality of circumferential retaining ridges 7, 7*a* as depicted in FIG. 9. FIG. 10 shows the cooperating receptacle 2 having a corresponding number of circumferential grooves 11, 11*a* aligned to receive and cooperate with the circumferential retaining ridges 7, 7*a* of the attachment stud 3. Another aspect of the invention, on the receptacle as shown in FIG. 11 is a stud 3 having a roughened external surface 18. The receptacle 2 of FIG. 12 has a plurality of horizontal, circumferential ribs 17 receiving the attachment stud 3 of FIG. 12 and its roughened external surface 18 as shown in FIG. 13. Thus the roughened external surface 18 cooperates with circumferential ribs 17 for frictional engagement thus securely retaining the cleat body 1 within the receptacle 2.

Figure 14:
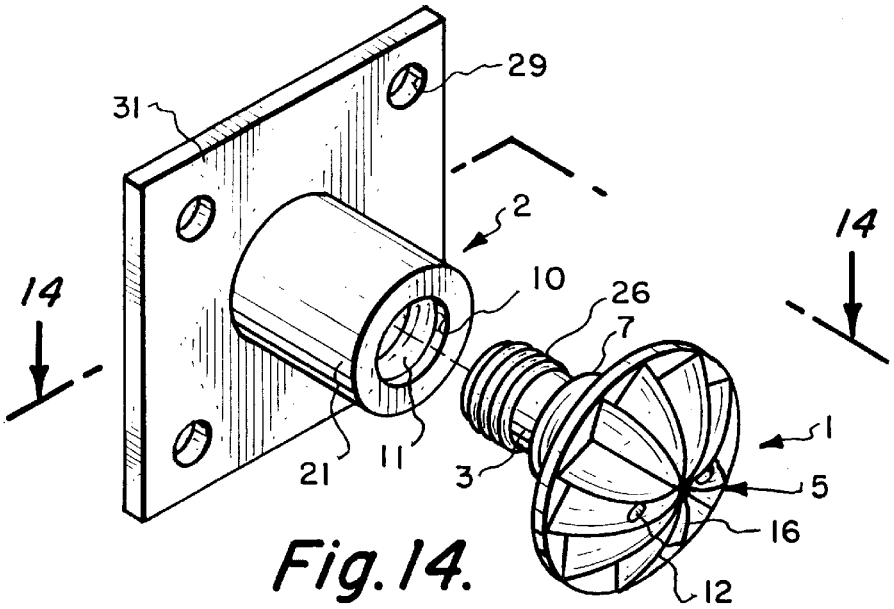
FIG. 14 is an isometric view of yet another embodiment of the cleat assembly of this invention in which the cleat has a threaded stud and the stud also includes an edge.
Figure 15:
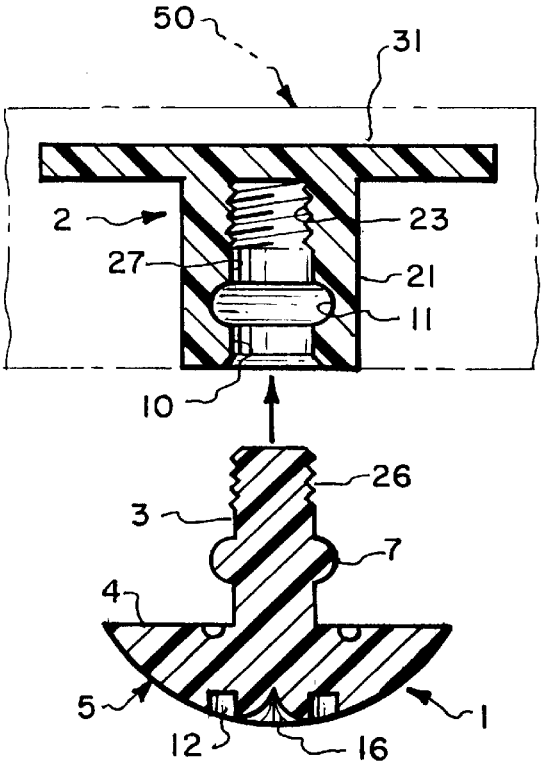
FIG. 15 is a view in section taken along line 15—15 of FIG. 14.
Figure 16:
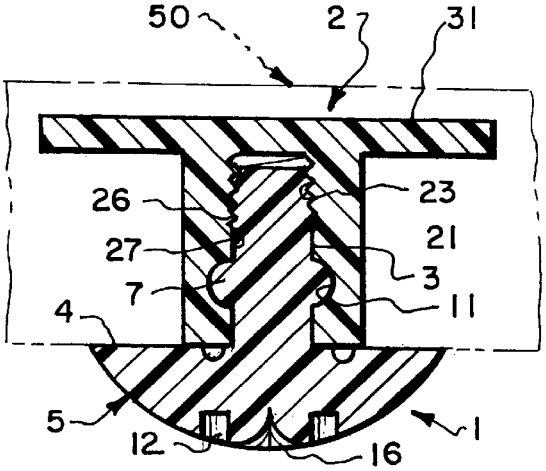
FIG. 16 is a view in section of the assembled cleat and receptacle shown in FIG. 15.

FIGS. 14–16 show another embodiment of this invention whereby the receptacle 2 has female threaded section 23 on the lower interior surface 27 of the wall 21. A circumferential groove 11 is disposed near the open end 10 of the receptacle 2 that accepts a conventional threaded spike and a cleat body of this invention. An attachment stud 3 includes a male threaded section 26 and a circumferential retaining ridge 7. Because of the deformable and resilient nature of the materials available to form the receptacle 2 and attachment stud 3, circular grooves around the perimeter of the attachment stud may be used instead of the threads. Thus the attachment stud 3 of FIG. 14 may either be rotated into the receptacle 2 as with a conventional threaded spike, or it may be pressed in with a linear, longitudinal motion.

It is to be realized that only preferred embodiments of this invention have been described, and that numerous substitutions, modifications, alterations, and applications are permissible without departing from the spirit and scope of the invention as defined in the following claims.

I claim:

1. A cleat assembly for shoes, comprising:

cleat body having a top surface, a cleat surface and an attachment stud formed from an elastomer upwardly projecting from the top surface, said stud having a first length and terminating in a distal end, an external surface, and an axial longitudinal bore extending from proximate to the top surface of said cleat body to the distal end; and a receptacle for inclusion in a shoe outsole having a base plate, a continuous wall with an interior surface defining an elongated cavity having a second length and a continuous end surface and a post within the elongated cavity attached to the base plate, said second length being larger than the first length whereby on insertion of the stud of said cleat body into said receptacle an annular chamber is formed between the end surface of the cavity and the distal end of the stud and said wall removably and resiliently receiving, and frictionally engaging the attachment stud of said cleat body.

2. A cleat assembly according to claim 1 wherein the post of said receptacle has an external wall sized to provide an interference fit within the axial longitudinal bore of the attachment stud of said cleat body, and said cleat body is formed of deformable and resilient materials thereby providing secure frictional and removable engagement in deformable and resilient cooperation between said cleat body and said receptacle when said receptacle is mounted in the sole of a shoe.

3. A cleat assembly according to claim 2 wherein the attachment stud has at least one circumferential retaining ridge disposed on its external surface between the top surface and its distal end, and wherein the interior surface of the wall defining the elongated cavity of said receptacle has circumferential grooves equal in number to the circumferential retaining ridges of the attachment stud which are aligned to cooperate with the retaining ridge(s) when said cleat body is frictionally, removably and securely received within said receptacle.

4. A cleat assembly according to claim 1 wherein the attachment stud of said cleat body has a roughened external surface and wherein the interior surface of the wall defining the elongated cavity of said receptacle has a plurality of circumferential ribs for deformable and resilient cooperation and secure and removable frictional engagement with the roughened exterior surface of the attachment stud of said cleat body.

5. A cleat assembly according to claim 1 wherein the base plate of said receptacle has a plurality of bonding apertures whereby the receptacle is attached to the outsole of a shoe.

6. A cleat assembly according to claim 1 wherein the cleat surface of said cleat body has a plurality of traction ribs for enhancing the traction of said cleat body with the ground, terrain or floor.

7. A cleat assembly according to claim 1 wherein said cleat body is fabricated from a material selected from the group consisting of elastomers, thermoplastic resins, and metals.

8. A cleat assembly according to claim 1 wherein said receptacle is fabricated from a material selected from the group consisting of elastomers, thermoplastic resins, and metals.

9. A cleat assembly according to claim 1 wherein the wall and post of said receptacle are fabricated from a metal and the cleat body is fabricated from an elastomer.

10. A cleat assembly according to claim 1 further comprising a reinforcement member embedded within said cleat body wherein the reinforcement member is fabricated from a material selected from the group consisting of rigid synthetic plastic resins or metals.

11. A cleat assembly according to claim 1 wherein the wall defining the elongated cavity has longitudinal slots forming a plurality of wall sections whereby the attachment stud of said cleat body is resiliently and flexibly received.

12. A shoe comprising:

an upper;

a midsole attached to said upper;

an outsole attached to said midsole; and a plurality of said receptacles of the cleat assembly defined in claim 1, included within said outsole.

* * * * *